US005318226A

United States Patent [19]

Kime et al.

[11] Patent Number: 5,318,226

[45] Date of Patent: Jun. 7, 1994

[54] DEPOSITION OF SNOW-ICE TREATMENT MATERIAL FROM A VEHICLE WITH CONTROLLED SCATTER

[75] Inventors: James A. Kime; Jeremy J. Margeson, both of Columbus, Ohio

[73] Assignee: H.Y.O., Inc., Columbus, Ohio

[21] Appl. No.: 960,908

[22] Filed: Oct. 14, 1992

[51] Int. Cl.[5] ..... E01C 19/20; B60P 1/00

[52] U.S. Cl. ..... 239/1; 239/677; 239/684; 239/687

[58] Field of Search ..... 239/650, 661, 670, 672, 239/677, 681, 684, 687, 146, 172, 1

[56] References Cited

U.S. PATENT DOCUMENTS

| | | | |
|---|---|---|---|
| Re. 33,835 | 3/1992 | Kime et al. | 239/684 X |
| 3,171,658 | 3/1965 | Clark | 239/687 |
| 3,539,113 | 11/1970 | Tyler | 239/684 X |
| 4,898,333 | 2/1990 | Kime et al. | 239/684 X |

*Primary Examiner*—Andres Kashnikow
*Assistant Examiner*—Lesley D. Morris
*Attorney, Agent, or Firm*—Mueller and Smith

[57] ABSTRACT

Apparatus and method is described for depositing salt-based materials upon highway pavements at practical speeds in a manner significantly reducing scatter. This is achieved through the expression of the materials from an impeller at a lower level of the vehicle at a material velocity commensurate with the speed of the vehicle itself. Projection of the material is in a direction or vector directly opposite that of the forward direction of the vehicle. Implementation of the method is provided with a rotating impeller having sidewalls defined by an endless belt which partially surrounds it. That portion of the impeller which is not surrounded by the endless belt forms an outlet opening from which the material is propelled. Introduction of the material to the impeller is at its center portion and is directed to those peripheral regions of the impeller which extend from a location adjacent the outlet opening and thence about a predetermined arcuate region of the rotating impeller. A plurality of rotationally rearwardly canted vanes are mounted within the impeller to aid in the acceleration and expulsion of the snow-ice control materials.

19 Claims, 8 Drawing Sheets

DEPOSITION OF SNOW-ICE TREATMENT MATERIAL FROM A VEHICLE WITH CONTROLLED SCATTER

BACKGROUND OF THE INVENTION

Highway snow and ice control typically is carried out by governmental authorities with the use of dump trucks which are seasonally modified by the addition of snow-ice treatment components. These components will include a forwardly-mounted plow and rearwardly-mounted mechanisms for broadcasting materials such as salt-aggregate mixtures. Such mechanisms conventionally include a feed auger extending across the back edge of the dump bed of the truck. This hydraulically driven auger effects a metered movement of material from the bed of the truck onto a rotating spreader disk or "spinner" which broadcasts or spreads the salt or salt-aggregate mixture across the pavement being treated.

In snow-ice control procedures heretofore undertaken, salt containing materials are spread during snow-ice build-up on interstate or principal highways at a rate of about 600 lbs per mile as a first or initial application. Secondary highways are treated at deposition rates of about 400 lbs per mile for such an initial application. Thereafter, the salt carrying trucks may follow-up with a reapplication of the selected treatment material at deposition rates of about 200 lbs per mile.

The speed of the snow-ice control vehicles necessarily is constrained during inclement weather conditions to about 15 miles per hour. This lower speed permits the broadcasting of salt-aggregate materials without undue loss to roadside regions. Additionally, the inclement conditions will generally cause traveling motorists to lower average speeds on the highway such that the slow, 15 mph trucks do not pose a severe slow moving hazard. Environmentalists have expressed concern with respect to the quantity of salt-based materials distributed into run-off channels by this treatment procedure. This concern has developed to an extent that investigators are looking for procedures which remain effective in snow-ice control while lessening the amount of control materials which must be used. One improvement in the controlled deposition of these materials has been achieved through the utilization of microprocessor driven controls over the hydraulics employed with the seasonally modified trucks. Kime, et al., in U.S. Pat. No. Re.33,835 entitled "Hydraulic System for Use with Snow-Ice Removal Vehicles", reissued Mar. 3, 1992, describe a microprocessor driven hydraulic system for such trucks with a provision for digital hydraulic valving control which is responsive to the instantaneous speed of the truck. With the hydraulic system, improved controls over the extent of deposition of snow-ice materials is achieved. This patent is expressly incorporated herein by reference.

Other techniques for improving snow-ice control have looked to selection of the timing of controlled material deposition. For example, the amount of material required for initial deposition can be reduced significantly where it is laid down prior to the commencement of storm generated precipitation. By so pre-treating highways, a brine is formed at the pavement surface at the onset of precipitation which prevents ice from bonding to the pavement surface. Additionally, this "pre-treating" procedure facilitates the removal of accumulated snow-ice by plowing procedures. By laying down the material, for example an hour before the commencement of storm precipitation, the amount of material required for an initial application may be, for example, 1/6th of that required after precipitation has commenced and snow-ice build-up is present on the highway. While such pre-treatment may be effective, the problem now becomes one of the technique of depositing it properly upon the highway surface. Snow-ice materials, utilized in conventional equipment, will remain on the highway surface at the time of deposition only where the depositing vehicles are traveling at dangerously slow speeds for dry pavement, for example, about 15 miles per hour. Above those slow speeds, the material is essentially lost to the roadside. Observation of materials attempted to be deposited at higher speeds shows the aggregates bouncing forwardly, upwardly, and being broadcast over the pavement sides such that the deposition at higher speeds is ineffective as well as dangerous and potentially damaging to approaching vehicles. However, the depositing trucks themselves constitute a serious hazard when traveling, for example at 15 mph, on dry pavement which simultaneously is accommodating vehicles traveling, for example at 65 mph. The danger posed is such as to preclude the practicality of pre-treating deposition. A practical technique is called for which controls the deposition of snow-ice materials while permitting the trucks to operate at those higher speeds which are reasonably safe with respect to approaching traffic on major interstate highways.

SUMMARY

The present invention is addressed to apparatus and method for depositing granula materials such as those suited for snow-ice removal upon a pavement or the like from a moving vehicle with controlled scatter at surface impact. With the method, these materials are propelled from the treatment vehicle at a velocity commensurate with that of the vehicle itself and in a direction opposite that of the vehicle. The result is an effective suspension of the projected materials over the surface under a condition of substantially zero velocity with respect to or relative to the surface of deposition. Depending upon vehicle speeds desired, material deposition may be provided in controlled widths ranging from narrow to wider bands to achieve proper control over material placement.

The material scatter control evoked with the invention is such that snow-ice control vehicles may travel over dry pavement at speeds which are sufficiently high for safety purposes while still effectively "pre-treating" these pavements. Such pre-treating achieves early brine formation at the pavement surface with advantageously lowered salt-grit quantity demands.

Requisite projection of the snow-ice removal material is achieved through the use of an impeller mounted upon the vehicle at a location selected to position its outlet relatively close to the pavement surface. To avoid excess pulverization of such granula material, the impeller is implemented having dynamic sidewalls formed of an abutting endless belt which, in turn, is configured having mechanically spaced loops defining the impeller outlet opening. Improved performance also is achieved through the introduction of the control materials in the region of the axis of rotation of the impeller and through the use of a plurality of impeller vanes which preferably are angularly canted rotationally rearwardly.

Another feature of the invention provides, in a vehicle of a variety suited for snow-ice control wherein a wheel mounted frame supports an internal combustion engine, a dump bed for carrying granula snow-ice control material, and including an auger mounted adjacent of the bed for transferring the material from the bed to an outlet at a predetermined rate, the vehicle being movable over pavement at a given forward velocity and forward direction, the improved apparatus for depositing the transferred material to the pavement which comprises a base connectable with the vehicle in spaced relationship with the auger outlet. Additionally, an impeller is provided which is mounted upon the base for rotation about an impeller axis and which has a lower disposed receiving surface extending from the impeller axis to define a circular outer periphery, and which further includes an input portion for receiving the material expressed from the auger outlet. A sidewall component is provided which extends about the impeller outer periphery and which defines an outlet opening through which the material received at the input portion of the impeller may be expressed at an outlet velocity and direction substantially oppositely aligned with respect to the vehicle forward direction. A drive arrangement is provided which is mounted upon the base and which is actuable for imparting rotation to the impeller at a rotational rate effective to move the material from the input portion to the circular outer periphery and for imparting a velocity to the outer periphery effective to eject the material at the periphery through the outlet opening at an outlet velocity at least as great as the vehicle given velocity.

Another feature of the invention provides a method for depositing granula material onto a surface from a vehicle moving along a given direction at a given velocity which comprises the steps of:

providing a quantity of the material for transport with the vehicle;

providing a material accelerating apparatus with the vehicle having input for receiving the material and an output for expelling the material at a select principal velocity and along a select principal direction;

feeding the transported material to the input at a predetermined rate corresponding with the given vehicle velocity;

expressing the material from the accelerating apparatus outlet at the select principal velocity of value at least as great as the value of the vehicle given velocity and with a select principal direction substantially opposite the vehicle given direction.

Still another feature of the invention provides apparatus for dispensing granula material at a predetermined rate upon a surface from a vehicle moving thereover in a given direction and at a given speed. The apparatus comprises a base connectable with the vehicle and an impeller mounted upon the base for rotation about an impeller axis. The impeller has a lower disposed receiving surface extending from the impeller axis to define an impeller circular periphery and an input portion for granula material. An upstanding endless belt assembly is provided which is supported from the base for movement with and formation of a side of the impeller at select portions of its circular periphery and which has spaced apart loop portions defining an outlet opening through which the material received at the input portion may be expressed at a predetermined principal outlet velocity and predetermined principal direction. A motor mounted with the base which is actuable to have a drive output for effecting the rotation of the impeller about the impeller axis and the movement of the belt is provided. A control arrangement responds to the vehicle given speed for actuating the motor to effect rotation of the impeller at a rate expressing the material at a principal outlet velocity which is commensurate with the vehicle given speed.

For a fuller understanding of the nature and objects of the invention, reference should be had to the following detailed description taken in connection with the accompanying drawings.

DETAILED DESCRIPTION

Figure 1:
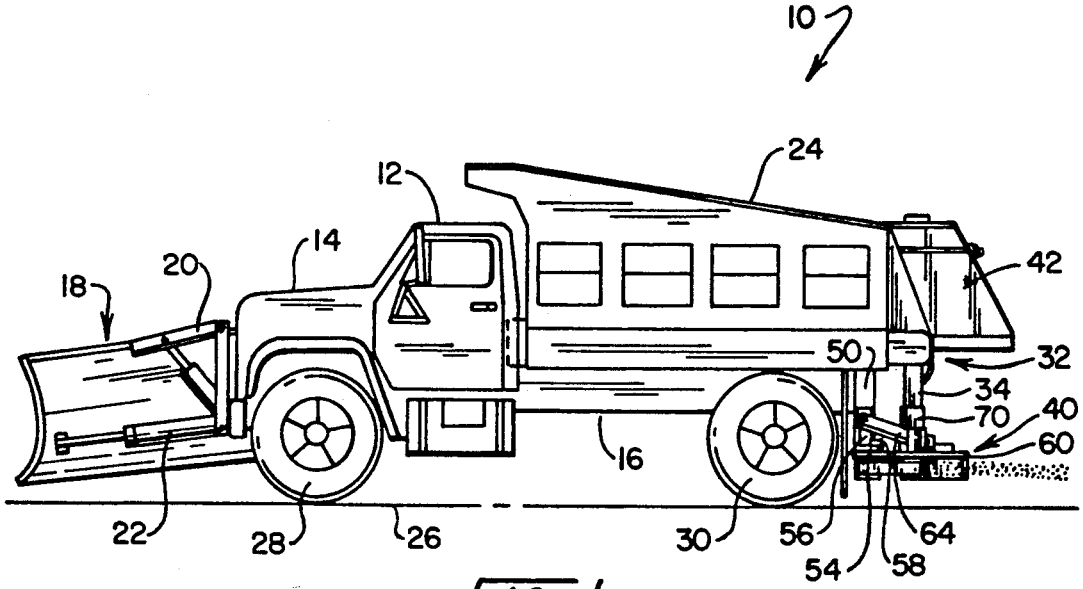
FIG. 1 is a side elevated view of a truck outfitted with the apparatus carrying out the method of the invention.

Referring to FIG. 1, a utility vehicle employed for the seasonal duties of snow-ice removal is revealed generally at 10. Configured as a dump truck, the vehicle 10 includes a cab 12 and hood 14 mounted upon a frame represented generally at 16. At the forward end of the vehicle 10 is mounted a snow plow 18 which is elevationally maneuvered by up-down hydraulic cylinder assembly 20. Additionally, the plow 18 is laterally, angularly adjusted by left- and right-side hydraulic cylinder assemblies, the left side one of which being represented at 22. Truck 10 supports a dump bed 24 which is selectively elevated about pivot connections at the rearward end of frame 16. The truck 10 additionally is seen supported on a pavement represented generally at 26 by the engagement of its wheels therewith two of which are represented at 28 and 30.

Additionally, seasonally attached to the truck 10 is a material distributing auger represented generally at 32 which has an outlet (not shown) for directing granula snow-ice treatment materials through a downwardly directed chute 34 to the input of a material accelerating apparatus represented generally at 40. In general, the granula material which is carried by the truck bed 24 will be a mixture of sodium chloride and sand or small sized aggregate sometimes referred to as "grit". The mixture may, for example, be present in a 50/50 percentage ratio. Looking additionally to FIG. 2, also mounted upon the truck body is a liquid container 42 having liquid output conduit extending therefrom at 44 to a pump 46. From the pump 46, the fluid within the tank 42 is directed via conduit 48 to the downwardly directed chute 34 for the purpose of mixing this fluid with the particulate mixture directed thereto from the auger 32. The liquid contained within container 42 typically is a combination of calcium chloride and water. This solution serves to promote the formation of brine by the deposited materials. Until such brine is evolved at the pavement 26, the salt has little affect upon precipitation other than serving as an aggregate to improve traction. For the purposes of the instant invention, the addition of the calcium chloride and water solution additionally functions to suppress or wet down powder component of the particulate material. Otherwise, powder formed by the distributing process may be blown away and ineffective in snow-ice control.

Figure 2:
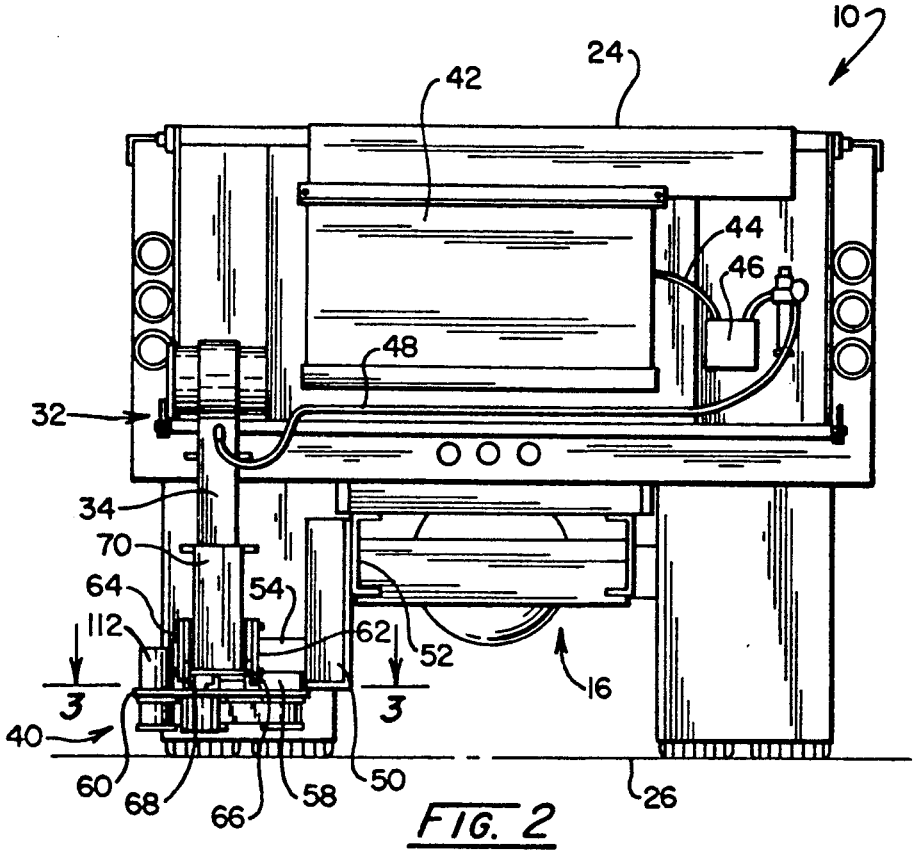
FIG. 2 is a rear elevated view of the truck of FIG. 1.

The material accelerating apparatus 40 is mounted upon the vehicle 10 by a steel angle iron assembly which includes a downwardly directed angular component 50 which is attached to channel member 52 of the truck frame 16. Connected to and extending laterally outwardly from the bottom of angular component 50 is a second angular component 54 having a horizontally disposed flange portion 56 which, in turn, engages an angle component 58 which is coupled by welding to a base member 60 of apparatus 40. To provide for seasonal installation and removal, the angular component 58 is bolted to the horizontal flange portion 56. The rearwardly outwardly extending extent of the base 60 is supported by two pivotally coupled bars 62 and 64 as are seen in FIG. 2. Bars 62 and 64, in turn, are connected to upstanding flanges shown, respectively, at 66 and 68 connected, in turn, to base 60. These flanges are seen additionally in FIG. 3 in sectional form along with angle component 58. The opposite sides of bars 62 and 64 are similarly pivotally connected to upstanding steel components (not shown) which, in turn, are welded to angle member second angular component 54.

Figure 3:
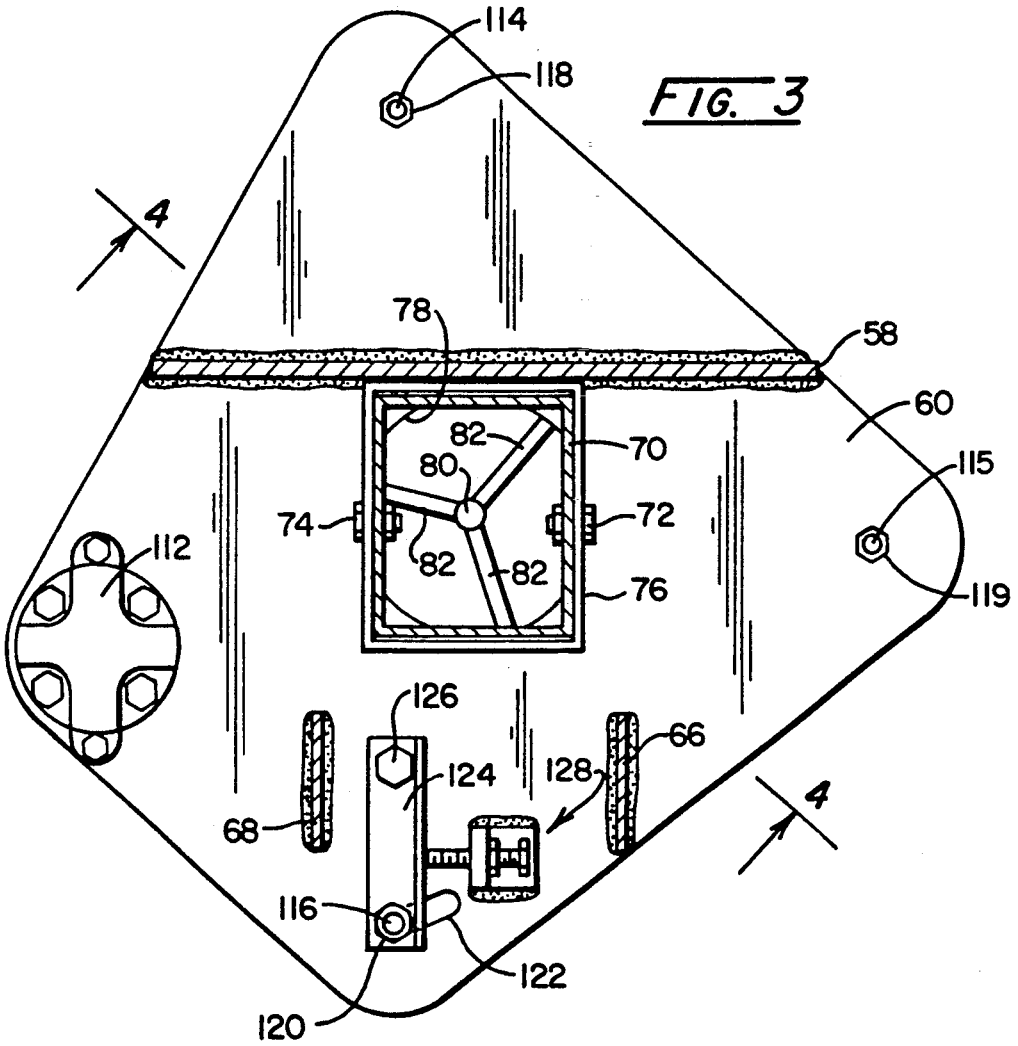
FIG. 3 is a sectional view taken through the plane 3—3 shown in FIG. 2.
Figure 4:
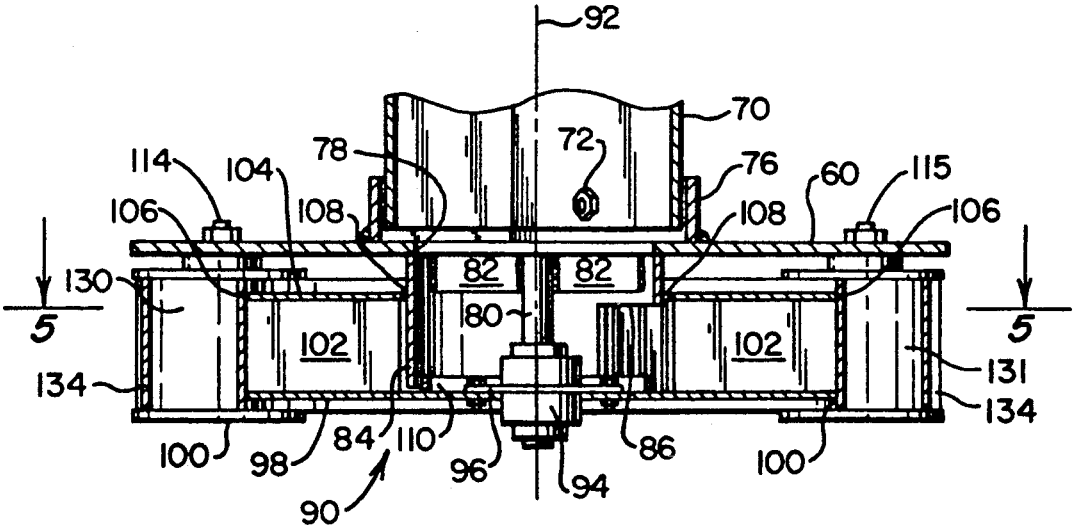
FIG. 4 is a sectional view taken through the plane 4—4 shown in FIG. 3.

It may be observed from FIGS. 1 and 2 that the apparatus 40 is mounted upon truck 10 at a location relatively close to the pavement surface 26. Such lower mounting, i.e. the lower surface is at a level of 10 to 12 inches from pavement 26, minimizes the dwell interval of expressed partial suspension over pavement 26 during operation of the system. Material supplied to apparatus 40 is directed from the auger 32 via downwardly directed chute 34 and into a second chute component 70 into which chute 34 is slidably inserted. FIGS. 3 and 4 reveal that the chute 70 is pivotally coupled to the base 60 by bolts 72 and 74 extending through a square upstanding and relatively short flange 76 which is welded to the top surface of base 60.

FIG. 3 further reveals that immediately beneath the second chute component 70 there is formed a circular aperture or opening 78 centrally disposed within which is a stationary shaft 80 which will be seen to serve as an impeller axle. The axle or shaft 80 is supported by a steel Y-shaped spider assembly with components represented at 82. Weldably secured to the bottom outer periphery of the opening 78 is a cylindrically shaped feed duct 84 which is seen in sectional view in FIG. 4. Duct 84 is cylindrical at its upper region but is cut along one side to define a notch providing a feed outlet portion, the edges of which are revealed at 86 in FIG. 4. With the arrangement thus far described, material being fed through the chutes 34 and 70 (FIG. 2) is further directed by the feed duct 84 for presentment through the feed outlet portion notch 86 to an impeller represented generally at 90 which rotates upon the shaft 80 and about an impeller axis represented at 92. Impeller 90 is seen in FIG. 4 to be supported for free rotation about axle 80 at a bearing or hub 94, the central portion of which is configured as an outwardly depending plate 96 which, in turn, is bolted to a lower disposed receiving surface 98. Surface 98 extends, in effect, from the hub 94 or axis 92 to a circular outer periphery represented at 100.

Bolted or welded to the receiving surface 98 are a plurality of upstanding vanes 102 which extend to and function to support a top plate 104 having an outwardly disposed circular periphery represented at 106 which is vertically aligned with the circular outer peripheral surface 100 of receiving surface 98. Top plate 104 extends inwardly to a circular opening, the edge of which is represented at 108 and is seen to rotate about the outer surface of feed duct 84. To provide a form of seal against the movement of material through the system into unwanted regions, a small cylindrical metal seal component 110 is welded to the receiving surface 98 just inwardly of the downwardly depending portions of feed duct 84.

Returning to FIG. 3, base 60 also is seen to support an upstanding hydraulic motor 112 which is bolted thereto as well as the axles 114–116 of three, freely rotating belt pulleys. Connection of these axles is by respective nuts 118–120. Axle 116 is seen to be movable within a slot 122 in base 60 by virtue of its connection with a short length of steel angle 124 which, in turn, is bolted for pivotal movement about a bolt 126 extending into base 60. The angular orientation of the steel member 124 and thus the position of axle 116 is adjustable and is retained by a threaded rod and bolt assembly represented generally at 128.

Returning to FIG. 4, axles 114 and 115 are seen to support freely rotating belt pulleys shown, respectively, at 130 and 131. These pulleys are engaged with and support an upstanding, flexible endless belt 134 about their outer peripheries.

Figure 5:
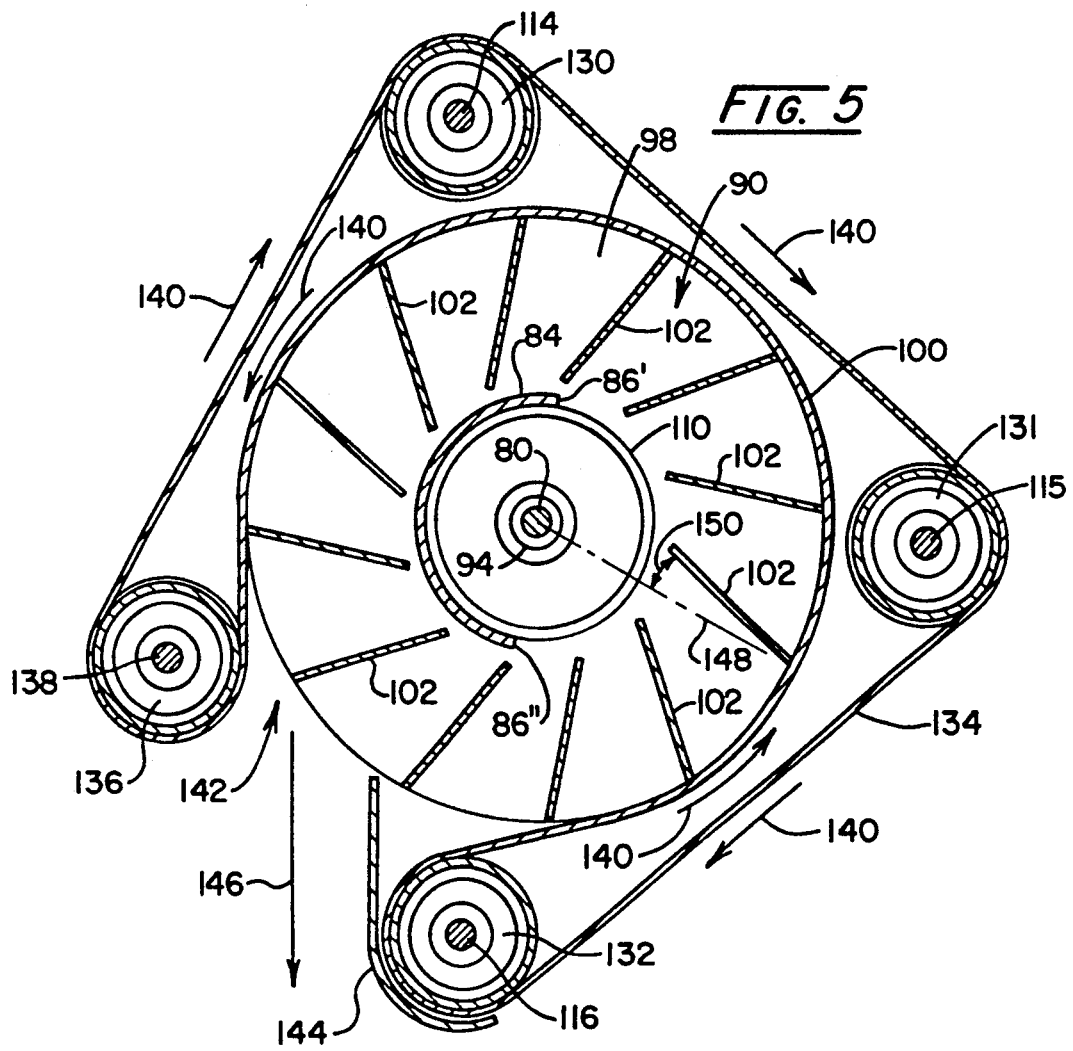
FIG. 5 is a sectional view taken through the plane 5—5 shown in FIG. 4.

Turning now to FIG. 5, the pulleys 130 and 131 again are revealed as well as a freely rotating pulley 132 which is supported from axle 116. To complete the circuit for belt 134, it may be observed that a driving pulley 136 is supported from the drive shaft 138 of hydraulic motor 112 (FIG. 3). Endless belt 134 is wrapped around the drive pulley 136 and the latter drive device functions to drive the belt 134 in the direction represented by arrows 140. In this regard, it may be seen that the belt 134 extends about the outer periphery of impeller 90 and functions as a sidewall component thereof extending about that outer periphery and having loop portions about pulleys 132 and 136 defining an outlet opening represented at 142. Finally, welded to the under side of base 60 is an outlet guide plate 144 which functions principally to protect the pulley 132 as it is engaged with belt 134. With the arrangement shown, drive rotation imparted from drive pulley 136, in turn, drives the endless belt 134, which, in turn, drivably rotates the impeller 90. In operation, material is directed through the chutes 34 and 70 and thence into the feed duct 84. The earlier-described notch at the lower region of duct 84 defines the feed outlet or opening extending as shown in FIG. 5 between edges 86' and 86" of the notch. It may be observed that ending position 86' is located, in a rotational sense, about 180° from notch portion or edge 86". Accordingly, the granular material is caused to move onto the receiving surface 98 within the region defined by notch 86 and by centrifugal force, is moved into the impeller regions intermediate vanes 102. As this occurs, the material then is urged to the outer circular periphery, for example at 100 of surface 90, and against the inwardly disposed surface of sidewall defined by belt 134. At this outer peripheral position, the material is accelerated to a predetermined rate of movement or velocity such that it then exits from outlet opening 142 having a speed and direction represented by the vector arrow 146. The direction of the material as represented at vector 146 is selected as opposite the forward direction of the vehicle 10. The speed or velocity of the material exiting along this vector 146 is selected to be at least as great as the instantaneous velocity of the vehicle 10. As a consequence, the material which exits from outlet opening 142 exhibits a speed or velocity with respect to pavement 26 which is substantially zero. In effect, the material is suspended relatively motionlessly in air slightly above the pavement 26.

Considering again the delivery of material into the impeller 90, it may be observed that the vanes 102 are canted rearwardly in the sense of the direction of rotation of impeller 90. Note, in this regard, that a vane such as at 102' will be oriented angularly rotationally rearwardly with respect to a radius 148 by an angular extent represented at 150. This angle will, for example, be about 30°. Note, additionally, that the granular material introduced to the impeller 90 through the feed duct 84 enters impeller 90 essentially at its rotational center. As a consequence, the material initially is subjected to lower rotational velocities and is gradually centrifugally driven to the outer peripheral sidewall established by flexible belt 134. Note further that this movement is slightly rotationally rearwardly directed by virtue of the angular orientation of vanes 102. Thus, the dwell interval of the material as it reaches the fastest circular speed of the system is enhanced to assure that the material reaches a desired speed commensurate with that of vehicle 10. Introduction of materials at locations within the impellers other than the "quiet" center, led to excessive grinding of the material. This undesirable grinding of material also has been observed to occur when using a stationary outer sidewall as opposed to that defined by flexible belt 134. Powderous materials exiting from the outlet opening 142, tend to remain in air suspension and will not deposit adequately upon the roadway. Control over powdering also, as indicated above, may be developed through the admixing of liquid calcium chloride or other liquids as represented at conduit 48 in FIG. 2. FIG. 5 shows the presence of twelve vanes 102. This is the preferred number of vanes, serving to avoid pulsations in the outputted stream of material.

Figure 6:
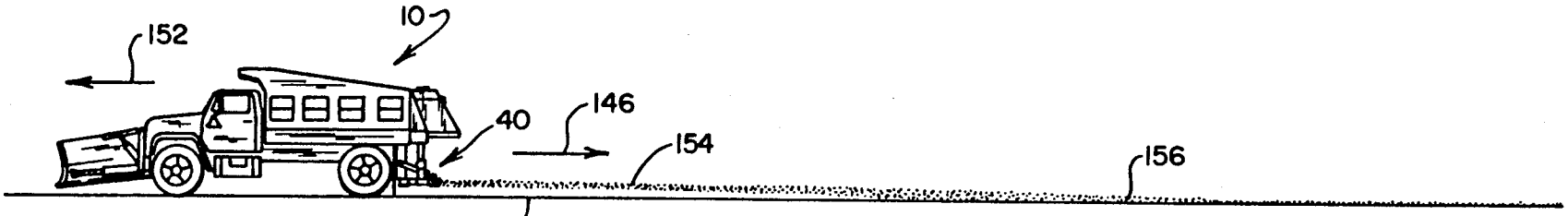
FIG. 6 is a side elevated view of a truck outfitted according to the invention illustrating the result of material deposition in accordance with the invention.
Figure 7:
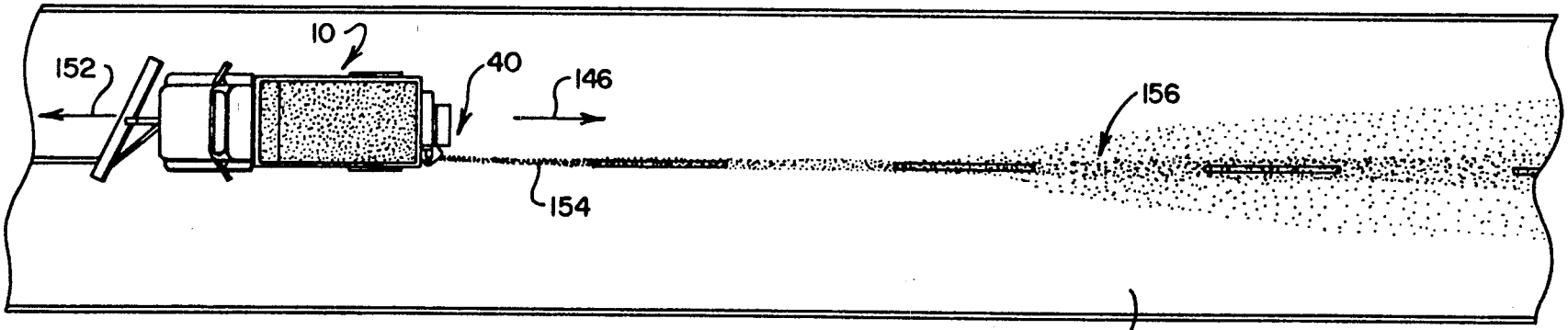
FIG. 7 is a top view of the vehicle and material deposition arrangement shown in FIG. 6.

Looking momentarily to FIGS. 6 and 7, a representation of the depositing performance of the apparatus 40 is depicted for a condition wherein truck 10 is moving over highway pavement 26, for example, at a rate of about 30 mph. Truck 10 will be moving forwardly and at a given speed or velocity as represented by the vector arrow 152. The equal and opposite material ejecting vector arrow as described at 146 in connection with FIG. 5 again is reproduced as having the same direction and magnitude as vector 152. With the arrangement shown, as the material is expressed from outlet opening 142 of the apparatus 40, it initially is suspended essentially at the low elevation of the apparatus 40 above pavement 26 as represented at 154. This suspension of particulate material has no relative velocity with respect to pavement 26 and falls downwardly as represented at region of material 156. Depending upon the speed of vehicle 10, the material at region 156 will broaden, for example, for a 35 mph distribution speed of vehicle 10, the distribution width may be about 2 feet. Where slower speeds are contemplated, the system of the invention has the capability of laying down a very narrow deposition, for example about 6 to 12 inches in width. FIG. 7 shows vehicle 10 being utilized in conjunction with a two lane road having a crown at the center line. With this arrangement, as precipitation ensues following deposition, the material will evoke a needed brine which will flow from the crown of the road. For major or principal interstate highways, the material can be laid down as a band which treats the region of pavement where two generally aligned vehicle wheels will be engaged, for example the left front and rear wheels of any given automobile. This will provide concentrated ice control at a pathway for those wheels which will give adequate stability to vehicles so traversing these regions.

Figure 8:
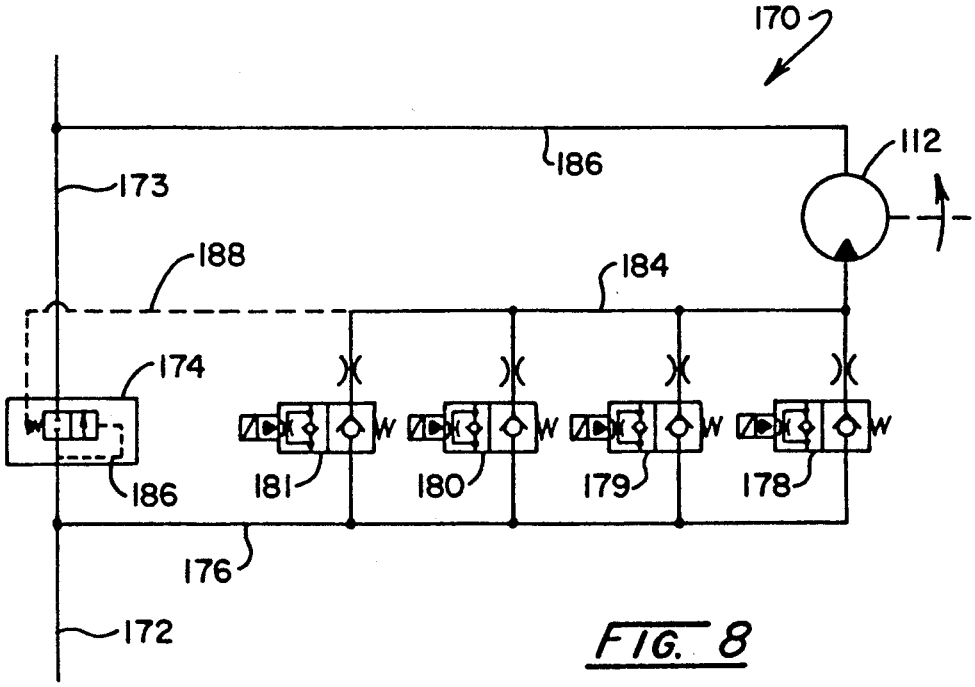
FIG. 8 is a schematic hydraulic circuit diagram showing that portion of the hydraulic system of the truck of FIG. 1 employed for driving an impeller in accordance with the invention.

As described in detail in noted U.S. Pat. No. Re. 33,835, the hydraulic circuit employed with vehicle 10 is in series such that the flow from a pump function first satisfies the requirements of the auger 32. The entire flow from the pump function then is available to the accelerating apparatus 40 and then, if needed, it is available for the bed hoist and plow functions. Pressures for each such function are additive and the peak pressure for the series circuit is higher than for a corresponding parallel circuit. Typical pressures for the auger 32 with free-flowing material is 300–500 psi and the pressure for the apparatus 40 is usually under 200 psi. With the series arrangement, no horsepower is wasted with respect to the primary engine of vehicle 10 in providing pump capacity for the bed and plow when they are not in use. This represents an advantage, for example, over parallel systems. Looking to FIG. 8, that component of this series hydraulic system employed for driving the hydraulic motor 112 of apparatus 40 is schematically portrayed in general at hydraulic network 170. Network 170 is coupled to a principal or main hydraulic line 172. This line 172 is seen to extend both to a hydraulically actuated by-pass valve 174 and to a line 176 extending to one side of a grouping of four speed controlling solenoid actuated valves 178–181. The opposites sides of valves 178–181 extend to line 184, in turn, extending to line 186 containing motor 112 represented in the figure in symbolic fashion. Line 186 is seen to return to line 173 on the opposite side of by-pass valve 174. The activity of valve grouping 178–181 is monitored by pilot lines as represented at 186 and 188 to effect appropriate by-pass pressure compensation of valve 174. To provide for binary speed control, valves 178–181 may each be assigned one value in a sequence of binary numbers, for example, $2^0$–$2^3$.

Figure 9:
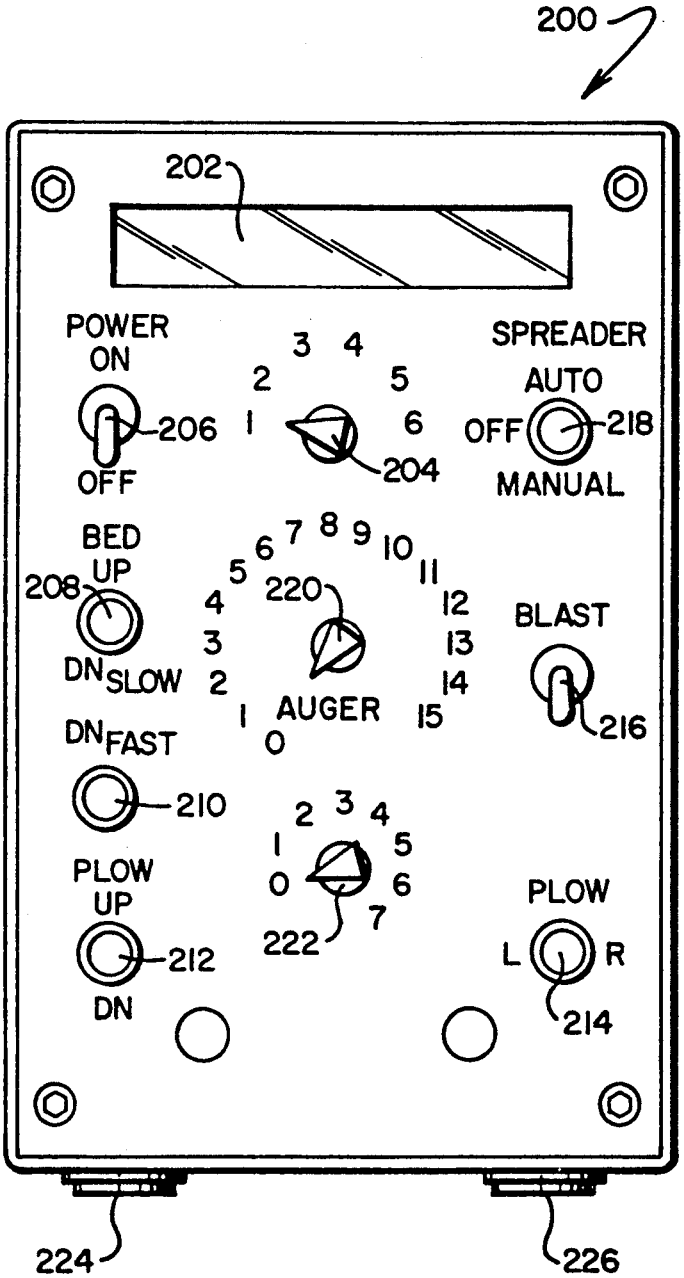
FIG. 9 is a front view of the panel of a control box or console incorporated within the cab of a vehicle incorporating the instant invention.

Microprocessor driven control over the hydraulic systems employed with the vehicle 10 is described in detail in the noted U.S. Pat. No. Re. 33,835. Supporting electronic components are retained with the cab 12 of vehicle 10 and, preferably, within a tamper-proof and environmentally secure console or control box. Referring to FIG. 9, such a control box or console is represented in general at 200 as including an LCD display 202 providing for readouts to the operator based upon the positioning of a mode switch 204. Switch 204 is movable to any of six positions from 1 through 6 providing, respectively: the speed of vehicle 10 in miles per hour; the deposition of material rate in pounds per mile; day and time; distance measuring in feet from a stop position; distance measuring from a stop position in miles; and a data logging option. Main power is controlled from switch 206 and the movement of the bed 24 up and down normally or slowly is controlled from switch 208. Correspondingly, a fast down movement of bed 24 can be controlled from switch 210. Control over the plow 18 in terms of elevation is provided at switch 212, while left-right or plow angle control is provided from switch 214. Auger blast actuation is developed at switch 216 and the selection of either a fully automatic spreading function or a manual spreading function is elected by actuation of toggle switch 218. Additionally, the switch 218 has an orientation for turning off the spreader function. When this switch is in an automatic orientation, the amount of snow-ice material is controlled automatically with respect to the speed of vehicle 10 and predetermined inserted data as to, for example, poundage per mile. When in a manual operational mode, the rate of material output is manually set by the operator. In electing these amounts, for example, an auger switch 220 may be positioned at any of 16 detent orientations for selecting the quantity of material deposited. When the system is in automatic mode as elected at switch 218, this switch 220 selects the rate of material application in pounds per mile adjusting the hydraulic control system automatically with respect to vehicle speed. The control of the speed of a spinner or the speed, for the instant application, of the impeller 90, is manually selected by the 8-position switch 222. When switch 218 is in an automatic mode and the impeller switch 222 is in the eighth position, the speed of impeller 90 is automatically elected with respect to vehicle speed. Thus, to invoke the operation of the instant invention, switch 222 is set to its eighth position or number 7 and the switch 218 is set for an automatic mode of spreader control. Two additional switches are provided at console 200 and these switches are key-actuated for security purposes. The first such switch as at 224 provides a manual lock-out function wherein the operator is unable to operate the system on a manual basis and must operate it in an automatic basis. Corresponding switch 226 moves the control system into a calibrate/-maintenance mode.

Figure 10:
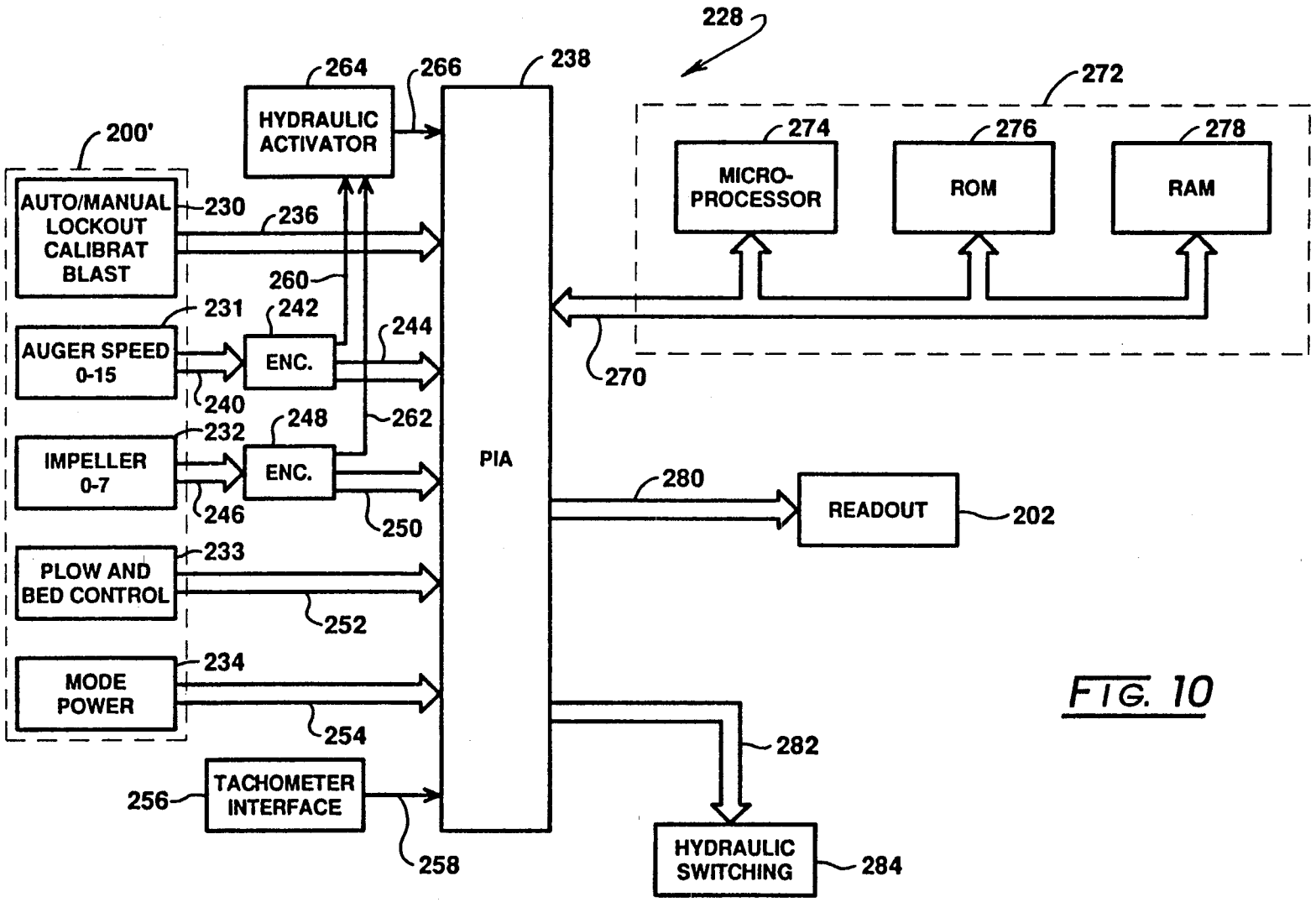
FIG. 10 is a block schematic diagram of a control circuit which may be employed with the invention.

Referring to FIG. 10, a block diagrammatic representation of a microprocessor driven input/output control function for vehicle 10 is represented generally at 228. The switching function connected with the console 200 is represented within dashed boundary identified by that same numeration in primed fashion. The multi-lead logic of this switching is represented within the boundary 200' by blocks 230–234. In this regard, inputs from auto/manual switch 218, the manual lock-out keyed switch 224, calibrate/maintenance keyed switch 226, and the blast switch 216 are represented at block 230 within boundary 200' as providing inputs via a bus 236 to a Programmable Interface Adapter function (PIA) represented at block 238. These devices, which may be provided as type 65C22 marketed by Rockwell International. Four such devices, for example, are employed in the circuit as described in the above-noted U.S. Pat. No. Re. 33,835.

The auger speed selection switch 220 as represented at block 231 provides an output at sixteen leads as represented at 240 to an encoder function represented at block 242. This encoding function, for example, provides for sixteen-line to three-line encoding which then is presented via bus 244 to PIA function 238. Similarly, the impeller speed switch 222 provides an eight-lead output at bus 246 which is encoded by an eight-line to three-line encoder represented at block 248, the output of which is represented at bus 250 extending to PIA function 238. Such encoders may be provided, as type 74C148.

The plow and bed control switches as described in conjunction with FIG. 9 at switches 208, 210, 212, and 214 are represented at block 233 as providing an output at bus 252 which is directed to the PIA function 238. Similarly, the mode selection switch 204 and power switch 206 provide outputs to PIA function 238 via bus 254. Speed information corresponding with the instantaneous velocity of the vehicle 10 is represented as being provided from block 256 and line 258 to PIA function 238. Similarly, logic is called for to activate the main hydraulic motor installed with the prime engine of vehicle 10. Such logic input may be provided, for example, from encoder functions 242 and 248 as represented by respective lines 260 and 262 to the hydraulic activating function as represented at block 264. Interactive association of this function 264 with PIA function 238 is represented line 266.

PIA function 238, in turn, appropriately processes the above-listed input functions and provides corresponding output logic signals at main bus function 270 which, in turn, is interactively associated with a controller function represented by dashed boundary 272. This controller function will include a microprocessor as represented at block 274. Such a device, for example, may be provided as a type 65C02 microprocessor by Rockwell International performing in conjunction with a 1 MHz clock. The microprocessor function 274 operates, in conventional manner, with a read only memory function (ROM) represented at block 276 via main bus 270. One embodiment for such function, for example, will include a type 2764 EPROM as well as a type 2817 EEPROM. Additionally, the microprocessor function performs in conjunction with busing function 270 and a random access memory (RAM) function represented at block 278. RAM function 278 may be provided with a type 6264 device. Output from PIA function 238 also may be provided to the earlier-noted readout 202 as represented at bus 280 extending to a block identified by the same numeration, 202.

The hydraulic controlling output from PIA function 238 is represented at bus function 282 which will extend to switching components carrying out hydraulic switching as represented at block 284. These switching components may, for example, be provided as type MTP8P08 field effect transistors marketed by Motorola, Inc. The switching activities provide, inter alia, for the switching of earlier-described control valves 178–181, regulating the rotational speed of an impeller 90.

Figure 11:
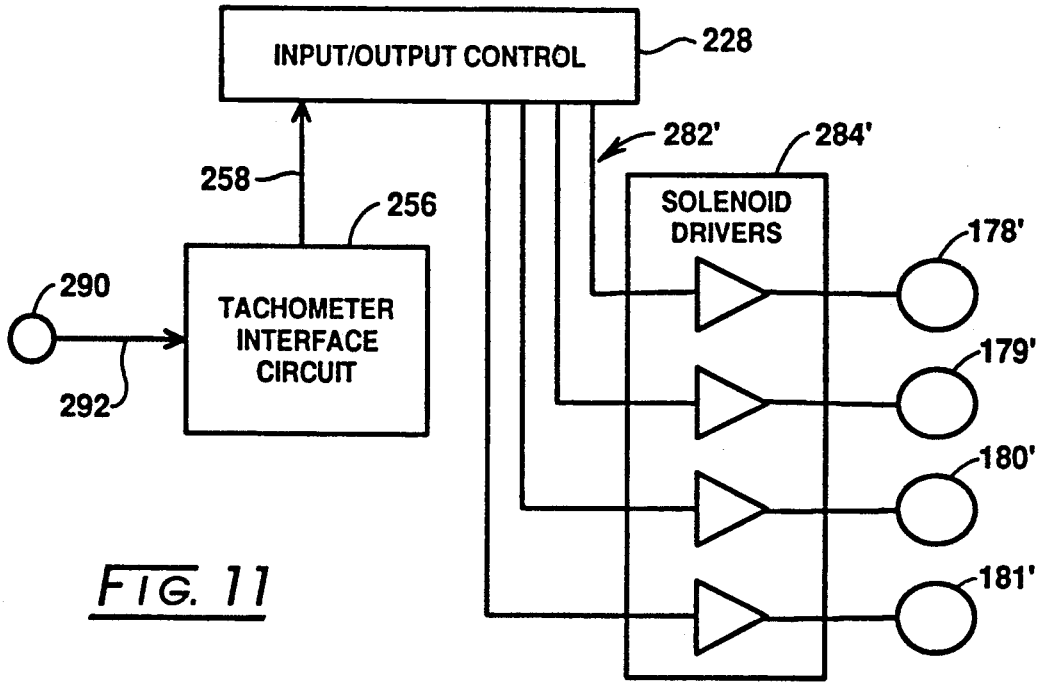
FIG. 11 is an abbreviated block diagram showing portions of the control circuit of FIG. 10.

Referring to FIG. 11, a representation of the input-/output control function as it is associated with impeller valves 178–181 is revealed. In the figure, a vehicle and tachometer input is represented at 290 which is directed via line 292 to the earlier-described tachometer interface circuit represented again at block 256. The logic level output of circuit 256 is directed, as earlier described, via line 258 to the input/output control function 228 again represented by that numeration. Function 228, in turn, develops logic solenoid drive signals which are directed via bus 282 herein represented at 282' to a solenoid driver function as earlier described at 284 and represented herein by the same numeration in primed fashion. These drivers 284' develop an enhanced output for switching purposes which is directed to the solenoid windings of valves 178–181, herein represented by respective circuits 178'–181'. The control 228 calculates vehicle 10 speed, for example in miles per hour, from the input signal at line 258 and then creates the electrical outputs for controlling the speed of the impeller 90. This, in turn, controls the output velocity of material ejected by that device. In this regard, the outflow speed of the material is matched to the forward speed of vehicle 10 resulting in a zero relative velocity between the material and the road surface or pavement.

Figure 12:
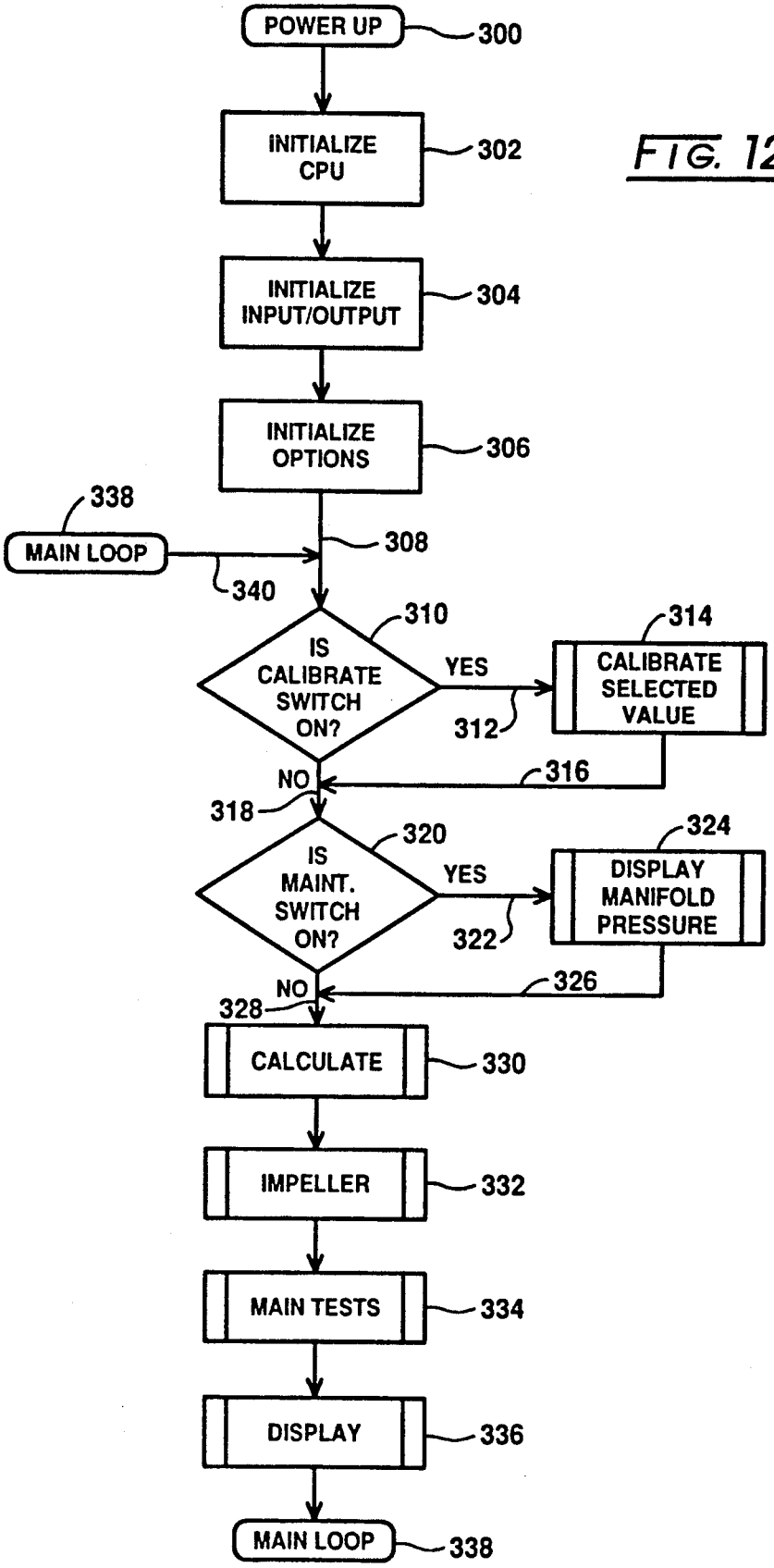
FIG. 12 is a flow chart showing the general control program employed with the invention.

Referring FIG. 12, a general flow diagram for the operation of controller 272 is revealed. This operation commences with power-up as represented at node 300, whereupon, as represented at block 302, the central processing unit or microprocessor function 274 is initialized. This initialization, in conventional manner, will involve the setting of a stack pointer; the disabling of interrupts; the clearing of memory; the loading of constants into memory; the initialization of a real time clock, and the loading of current time. Then, as represented at block 304, the input/output functions are initialized. This will involve the setting up of input/output circuits; the creation of interrupt vectors; and the display of the system identification number. Then, as represented at block 306, options are initialized. This will involve the detection of pressure circuitry; the detection of telemetry circuitry; and/or the detection of the presence of a four-or five-bit auger drive function. The program then continues as represented at line 308 to the query posed at block 310 determining whether the key activated calibrate switch 226 is on. In the event that it is, then as represented at line 312 and block 314, a subroutine is entered into wherein calibration is carried out with respect to selected values, for example, for rate of deposition and the like. The program then continues as represented at lines 316 and 318. In the event that the calibrate switch has not been activated or at the completion of the calibration sub-routine 314, then as represented at line 318 at block 320, inquiry is made as to whether the maintenance orientation of switch 226 has been activated. In the event that it has, then as represented at line 322 and block 324, the system enters a sub-routine providing for the display of manifold pressure and, following that display, as represented at lines 326 and 328, returns to the main program. Where the sub-routine represented at block 324 has been completed or in the event of a negative determination with respect to the query posed at block 320, then as represented at line 328 and block 330, the program enters a calculate sub-routine. This sub-routine serves to calculate the current speed of vehicle 10 in miles per hour; the current deposited pounds per mile of snow-ice material; and creates or develops a proper speed setting for the auger function 32. The program then enters a subroutine represented at 332 wherein ground-based impeller calculations are carried out and the valves 178–181 are activated accordingly. Then, as represented at block 334, main tests are carried out in a sub-routine which tests for low fluid level; an empty auger; an over-pressure condition; an over-temperature condition in the hydraulics; and carries out any mandated telemetry function. As represented at block 336, a display sub-routine then is entered which carries out at display 202 of the function elected by mode switch 204 as described in conjunction with FIG. 9. The program then, as represented at node 338, returns to its main loop. In this regard, node 338 reappears in the figure in conjunction with line 340 extending to earlier-noted line 308.

Figure 13:
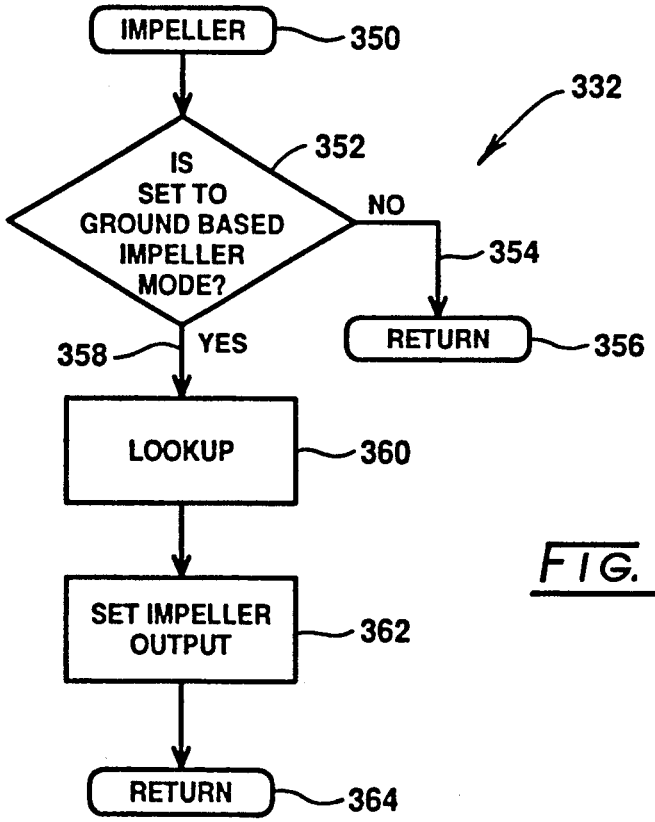
FIG. 13 is a flow chart showing a sub-routine employed by the program of FIG. 12.

Looking to FIG. 13, the impeller sub-routine 332 is revealed at an enhanced level of detail. This routine is entered as represented at node 350, and an inquiry is made as to whether the switching at console or control box 200 has been set to a ground based impeller mode. It may be recalled that this is carried out by setting spreader control switch 218 to an automatic operation and adjusting the impeller switch 222 to an eighth or number 7 position, the positions ranging from 0 through 7. In the event that the noted switching is not in those orientations, then the sub-routine returns to the main program as represented at node 356. However, where that form of operation is called for, then as represented at line 358 and block 360, a look-up function ensues. This function reads the current speed of vehicle 10 in miles per hour then looks through a ground-based impeller speed table and locates a speed range for the impeller containing the current vehicle speed. An example of such a table, which is utilizing values calibrated by the user during system set-up may be provided as follows:

| | |
|---|---|
| 0 to 6 mph = | valve combination 1 |
| 6.1 to 12 mph = | valve combination 2 |
| 12.1 to 18 mph = | valve combination 3 |
| 18.1 to 24 mph = | valve combination 4 |
| 24.1 to 30 mph = | valve combination 5 |
| 30.1 to 36 mph = | valve combination 6 |
| above 36 mph = | valve combination 7 |

The program then continues to the instructions represented at block 362 wherein the impeller output is set. In this regard, the impeller output values according to the noted table are set in the system and, as represented at node 364, the sub-routine returns to the main program.

A test of apparatus constructed in accordance with the teachings hereof was conducted by Mr. Howard Stone, an equipment superintendent of a state Department of Transportation on May 22, 1992. Two snow-/ice treatment vehicles were utilized and identified as follows:

Truck No. 1: NAVISTAR International, Inc., 4900 Series 1992 S.N. 436588 (GVW 31,000 lbs)

Truck No. 2: NAVISTAR International, Inc., 4900 Series 1992 S.N. 439559 (GVW 31,000 lbs).

Truck No. 1 was equipped with the impeller-type apparatus of the invention, while Truck No. 2 was equipped with a conventional disk-type spreader. The beds of the trucks were loaded with standard snow-ice control salt particles and the spreader controls of each were set to deposit the salt at a 600 pounds per mile value. A two-lane roadway representing one-half of a four-lane divided highway was used for the test. The roadway was identified as a portion of US 35 extending from Frankfort, Ohio, to Chillicothe, Ohio. This two-lane portion of th roadway was crowned at the center. The roadway was dry and light winds were observed.

Salt deposition was made over the crown of the roadway as identified by divider stripes.

Each truck was operated at speeds of 20 MPH, 30 MPH, 40 MPH, 45 MPH (Truck No. 2) and 50 MPH (Truck No. 1) while the material was deposited. A video recording of the deposition was made from a chase car following the trucks at distances ranging from immediate adjacency to about one-eighth mile. The observed material (salt) placement which was considered to be wasted (out of highway vehicle traction zone) for the above speeds was estimated by Mr. Stone to be as follows:

| Speed | Percentage Wasted |
|---|---|
| Truck No. 1 | |
| 20 MPH | 0–1% |
| 30 MPH | 0–1% |
| 40 MPH | 0–2% |
| 50 MPH | 2–3% |
| Truck No. 2 | |
| 20 MPH | 5% |
| 30 MPH | 10% |
| 40 MPH | 50–60% |
| 45 MPH | 60–80% |

The performances of Truck No. 1 and Truck No. 2 were recorded with a video camera (Panasonic AFX CCD Omni Movie Model PV-400D-A, S.N. D9WA13888 MFD April/1989).

Since certain changes may be made to the above-described method and apparatus without departing from the scope of the invention herein involved, it is intended that all matter contained in the description thereof and shown in the accompanying drawings shall be interpreted as illustrative and not in a limiting sense.

We claim:

1. The method of depositing granular material onto a surface from a vehicle moving along a given direction at a given velocity, comprising the steps of:

providing a quantity of said material for transport with said vehicle;

providing a material accelerating apparatus with said vehicle having an input for receiving said material and an output for expelling said material at a select principal velocity and along a select principal direction;

feeding said transported material to said input at a predetermined rate corresponding with said given vehicle velocity; and expressing said feed material from said accelerating apparatus output in a manner wherein substantially all of said expressed material exits from said output along a vector defined having a said select principal velocity of value at least as great as the value of said vehicle given velocity and with a said select principal direction substantially opposite said vehicle given direction.

2. The method of claim 1 wherein said accelerating apparatus is provided as a rotating impeller having an axis of rotation and extending radially therefrom to a periphery, said input being located at said axis; and said step for feeding said transported material is carried out by moving said material into said input and gradually centrifugally urging it to said periphery.

3. The method of claim 2 in which said impeller is rotated at a rate providing a peripheral rotational velocity of value at least equal to said select principal velocity value.

4. The method of claim 3 in which said step of expressing said feed material is carried out by centrifugally locating said material upon an upstanding surface at said impeller periphery, said upstanding surface being provided as a flexible belt moving at said peripheral rotational velocity value.

5. In a vehicle of a variety suited for snow-ice control wherein a wheel mounted frame supports an internal combustion engine and a dump bed for carrying granular snow-ice control material and including an auger mounted adjacent said bed for transferring said material from said bed through an outlet at a predetermined rate, said vehicle being movable over pavement at a given forward velocity and forward direction defining a vehicle forward vector, the improved apparatus for depositing said transferred material to said pavement, comprising:

a base connectable with said vehicle;

an impeller mounted upon said base for rotation about an impeller axis, having a lower disposed receiving surface extending from said impeller axis to define a circular outer periphery and an input portion for receiving said material expressed from said auger outlet;

a sidewall component extending about said impeller outer periphery and defining an outlet opening through which said material received at said input portion may be expressed at an outlet velocity and outlet direction substantially oppositely aligned with respect to said vehicle forward direction; and drive means mounted upon said base and actuable for imparting rotation to said impeller at a rotational rate effective to move said material from said input portion to said circular outer periphery and for imparting a velocity to said outer periphery effective to eject said material at said periphery through said outlet opening at a said outlet velocity at least as great as said vehicle given velocity and in a direction defining a vector of movement of said expressed material which is substantially equal and opposite to said expressed vehicle forward vector.

6. In a vehicle of a variety suited for snow-ice control wherein a wheel mounted frame supports an internal combustion engine and a dump bed for carrying granular snow-ice control material and including an auger mounted adjacent said bed for transferring said material from said bed through an outlet at a predetermined rate, said vehicle being movable over pavement at a given forward velocity and forward direction, the improved apparatus for depositing said transferred material to said pavement, comprising:

a base connectable with said vehicle;

an impeller mounted upon said base for rotation about an impeller axis, having a lower disposed receiving surface extending from said impeller axis to define a circular outer periphery and an input portion for receiving said material expressed from said auger outlet;

a sidewall component configured as an upstanding endless belt having a surface positioned in abutting adjacency with said impeller circular outer periphery and having spaced apart loop portions defining an outlet opening through which said material received at said input portion may be expressed at an outlet velocity and direction substantially oppositely aligned with respect to said vehicle forward direction; and drive means mounted upon said base and actuable for imparting rotation to said impeller at a rotational rate effective to move said material from said input portion to said circular outer periphery and for imparting a velocity to said outer periphery effective to eject said material at said periphery through said outlet opening at a said outlet velocity at least as great as said vehicle given velocity.

7. The apparatus of claim 6 in which said drive means includes a drive component coupled in driving relationship with said endless belt.

8. The apparatus of claim 7 in which said endless belt is associated in driving relationship with said impeller at said circular outer periphery thereof.

9. The apparatus of claim 6 in which said impeller input portion is located substantially adjacent said impeller axis.

10. The apparatus of claim 6 in which said impeller includes a predetermined number of material engaging vanes positioned about said receiving surface and extending from said input portion substantially to said impeller circular periphery.

11. The apparatus of claim 10 in which each said vane is canted a predetermined angle rotationally rearwardly with respect to a radius extending from said impeller axis to said impeller circular periphery.

12. The apparatus of claim 10 in which said predetermined number of vanes is about 12.

13. The apparatus of claim 6 including control means responsive to said vehicle given speed for actuating said drive means to effect said impeller rotation at said rotational rate.

14. In a vehicle of a variety suited for snow-ice control wherein a wheel mounted frame supports an internal combustion engine and a dump bed for carrying grannular snow-ice control material and including an auger mounted adjacent said bed for transferring said material from said bed through an outlet at a predetermined rate, said vehicle being movable over pavement at a given forward velocity and forward direction, the improved apparatus for depositing said transferred material to said pavement, comprising:

a base connectable with said vehicle;

an impeller mounted upon said base for rotation about an impeller axis, having a lower disposed receiving surface extending from said impeller axis to define a circular outer periphery and an input portion located substantially adjacent said impeller axis for receiving said material expressed from said auger outlet;

a sidewall component extending about said impeller outer periphery and defining an outlet opening through which said material received at said input portion may be expressed at an outlet velocity and direction substantially oppositely aligned with respect to said vehicle forward direction;

a feed duct positioned at said impeller input portion, and having a feed outlet portion for directing said material into said impeller commencing at locations thereof rotationally beyond but substantially adjacent said outlet opening and extending to an ending position rotationally located about 180° therefrom; and drive means mounted upon said base and actuable for imparting rotation to said impeller at a rotational rate effective to move said material from said input portion to said circular outer periphery and for imparting a velocity to said outer periphery effective to eject said material at said periphery through said outlet opening at a said outlet velocity at least as great as said vehicle given velocity.

15. The apparatus of claim 14 in which:

said feed duct is configured having a circular inner periphery which includes a notched region defining said feed outlet portion; and including a cylindrically shaped seal fixed to and extending upwardly from said receiving surface and having a seal outer surface rotatably movable with said impeller in adjacency with said feed duct circular inner periphery.

16. Apparatus for dispersing granula material at a predetermined rate upon a surface from a vehicle moving thereover in a given direction and at a given speed, comprising:

a base connectable with said vehicle;

an impeller mounted upon said base for rotation about an impeller axis, having a lower disposed receiving surface extending from said impeller axis to define an impeller circular periphery and an input portion for receiving said granula material;

an upstanding endless belt assembly supported from said base for movement with and formation of a side of said impeller at select portions of said circular periphery and having spaced apart loop portions defining an outlet opening through which said material received at said input portion may be expressed at a predetermined principal outlet velocity and predetermined principal direction;

a motor mounted with said base and actuable to have a drive output for effecting the said rotation of said impeller about said impeller axis and the said movement of said belt; and control means responsive to said vehicle given speed for actuating said motor to effect rotation of said impeller at a rate expressing said material at a said principal outlet velocity commensurate with said vehicle given speed.

17. The apparatus of claim 16 in which said endless belt loop portions are defined by two, spaced apart belt pulleys mounted upon said base.

18. The apparatus of claim 16 in which:

said motor drive output is a drive pulley coupled in driving relationship with said endless belt; and said endless belt is associated in driving relationship with said impeller.

19. The apparatus of claim 16 in which said impeller input portion is located at said impeller axis.

* * * * *